US006122897A

United States Patent [19]

McClure

[11] Patent Number: 6,122,897

[45] Date of Patent: Sep. 26, 2000

[54] PACKAGE CREATION METHOD AND PRODUCT FORMED THEREBY

[76] Inventor: Paul A. McClure, 31521 119th St., Princeton, Minn. 55371

[21] Appl. No.: 09/212,515

[22] Filed: Dec. 16, 1998

[51] Int. Cl.[7] ..... B65B 61/02

[52] U.S. Cl. ..... 53/411; 53/412; 229/136; 229/246

[58] Field of Search ..... 53/131.2, 131.4, 53/133.4, 411, 412; 229/123.3, 246, 247, 136; 493/128, 130, 131, 132, 150, 151, 331, 333

[56] References Cited

U.S. PATENT DOCUMENTS

| | | | |
|---|---|---|---|
| 2,133,946 | 10/1938 | Bloomer | 229/246 |
| 3,272,422 | 9/1966 | Miller | 229/123.1 |
| 3,329,331 | 7/1967 | Morgan . | |
| 3,454,210 | 7/1969 | Spiegel et al. | 229/123.1 |
| 3,580,466 | 5/1971 | Thelen . | |
| 3,608,707 | 9/1971 | Miller | 229/132 X |
| 3,827,625 | 8/1974 | Miller . | |
| 4,903,844 | 2/1990 | Oglesby | 229/80 X |
| 5,108,028 | 4/1992 | Schillaci . | |
| 5,172,854 | 12/1992 | Epstein et al. . | |
| 5,655,705 | 8/1997 | Bates . | |
| 5,655,707 | 8/1997 | Jensen | 229/247 X |

FOREIGN PATENT DOCUMENTS 2 269 161 2/1994 United Kingdom .

*Primary Examiner*—Daniel B. Moon

*Attorney, Agent, or Firm*—Nawrocki, Rooney & Sivertson, P.A.

[57] ABSTRACT

A method of creating a package with reclosable resealable flaps. The package is defined by a blank formed by die cutting a continuous web or sheet of material after ink and a release coating have been applied to one side of the web but on different areas. The blank, when folded, provides a structure with a rectangular cross-section having four planar sides, each side with extending flaps. A package is formed by closing and securing the flaps on the bottom end of the structure using a permanent adhesive. The package is then filled with product. One top outer flap can have a release coating applied to an area which will be engaged by the opposite flap when closed. This release coating, in combination with a repositionable adhesive, will cause the opposed flaps to releasably adhere one another to secure and seal the top opening. Repositionable adhesive can also be applied, either to the release coating itself, or to the surface opposite the release coating to the seal. When the top flaps are initially closed during the packaging process, an area of permanent adhesive is placed on at least one of the flaps to secure the flaps to each other when closed.

6 Claims, 5 Drawing Sheets

PACKAGE CREATION METHOD AND PRODUCT FORMED THEREBY

BACKGROUND OF THE INVENTION

1. Field of the Invention

This invention relates to methods of creating a package, and in particular to methods of creating a reclosable, resealable package which can be opened and resealed a large number of times.

2. Description of Related Art

The typical reclosable package has opposing flaps with one flap having an extension which can be inserted into a mating slot in the opposite flap to secure the flaps together. This type of closure is relatively awkward to close, has little strength and does not reseal the package.

It would be desirable to be able to create a resealable package with a resealable closure with essentially the same strength and seal of the original glued closure, but which could be opened and closed easily and readily a large number of times, and when closed would also reseal the package.

SUMMARY OF THE INVENTION

The present invention provides a package with a resealable closure on one end which is easy for a user to open, reclose and reseal repeatedly, and which provides essentially the same closure strength and seal as the original closure.

This invention is incorporated into a conventional package arrangement typically having a rectangular cross-section and four planar sides. Each side has flaps extending from each end. The flaps from one set of sides are sized to overlap when closed.

Cardboard or plastic on a web or in sheet form provides the material used for the package. To create the package, a press is first used to simultaneously apply ink to first predetermined portions and a release coating to second predetermined portions of one side of the web or sheet. Dies are then used to cut blanks from the web or sheet material.

Blanks then formed have a generally rectangular shaped center section. For descriptive purposes, the top and bottom of the package formed from a blank extend across the width of the rectangular center section. The top of the package is determined by the orientation of printed material applied to the blank. Boundaries across the width of the center section, perpendicular to its length, define two major and two minor sides. The distance between boundaries alternate such that a major side alternates with an adjacent minor side. This results in one edge of the center section across its width also being the edge of a major side and the opposite center section edge also being an edge of a major side. The major and minor sides are not usually of equal length, the major sides usually being longer than the minor sides, but the sides made can be equal in length with no change in the invention methods.

The blank is also shaped to provide extending major and minor flaps along the width of the center section which extend from opposite edges of each respective major and minor area. The major flaps are sized and arranged on the resulting package such that one flap overlaps the other, when closed. The blank is also shaped to provide an overlap extension from an outer edge of the center section across its width.

The release coating is applied to the web or sheet on press in those areas which will form one of the top major flaps on the blanks. The coating is applied to the side of the flap that will be innermost and adjacent to the opposite top major flap when the flaps are closed on the resulting package.

The blank is folded at right angles along the boundaries between the sides to form a structure with the printed surface outermost. The overlap extension is also folded at right angles along the boundary with the center section such that it will overlap and extend opposite and under the side at the opposite end of the center section. That portion of the opposite side which overlaps the overlap extension has a permanent adhesive applied prior to folding the overlap extension to provide means for securing the overlapped portions together.

The flaps on the bottom end of the structure (the bottom end being determined by the orientation of the printed materials) are then bent inward essentially at right angles along their defining boundaries with the major flaps being outermost. The major flaps are also attached to each other at this time by a permanent adhesive applied between their inner adjacent surfaces to complete the package.

The package is then typically filled with a product through the open top end. The minor flaps on the top end are then bent inward at right angles along the boundaries between the flaps and their respective sides. In a first method a repositionable adhesive is then applied over the release coating. In a second method the repositionable adhesive is applied to the surface of the opposite major flap which will be overlying the release coating when the major flaps are closed. In a third method no release coating is employed, although a repositionable adhesive is applied so as to engage an outer surface of the opposite major flap. When the third method is used, the step of applying the release coating is simply omitted.

A permanent adhesive is then applied sparingly typically at a plurality of areas on what will become a surface adjacent another flap surface when the top major flaps are closed (that is, on either or both the outer major flap and/or the inner major flap). However, the permanent adhesive is not applied to a surface area on either flap covering the release coating or the area on the opposite flap which will be overlying the release coating when the flaps are closed. The major flaps are then bent inward at right angles to their respective major sides with the appropriate surfaces innermost until the inner surface of the outer major flap adheres to the outer surface of the inner major flap.

Whether a repositionable adhesive is placed either immediately on the release coating to transfer to the opposite major flap, or placed on the opposite major flap directly, since the repositionable adhesive is interposed between the release coating and the opposite major flap, it will have the same final result. This occurs because, if the repositionable adhesive placed directly on the release coating, the coating will transfer the repositionable adhesive to the opposite major flap when the flaps are closed because the repositionable adhesive adheres more tightly to the flap than to the release coating. This will result in the repositionable adhesive always being either on, or transferred to, the area of the opposite major flap overlying the release coating area, regardless of its original location of application. Thus the overlying release coating and repositionable coating will hold and reseal the two opposite major flaps together after the flaps are first opened and the permanent adhesive connection broken. If no release coating is used, then the attachment between the major flaps from the repositionable adhesive will not be as durable but will still effectively reseal the opening.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE INVENTION

Figure 1:
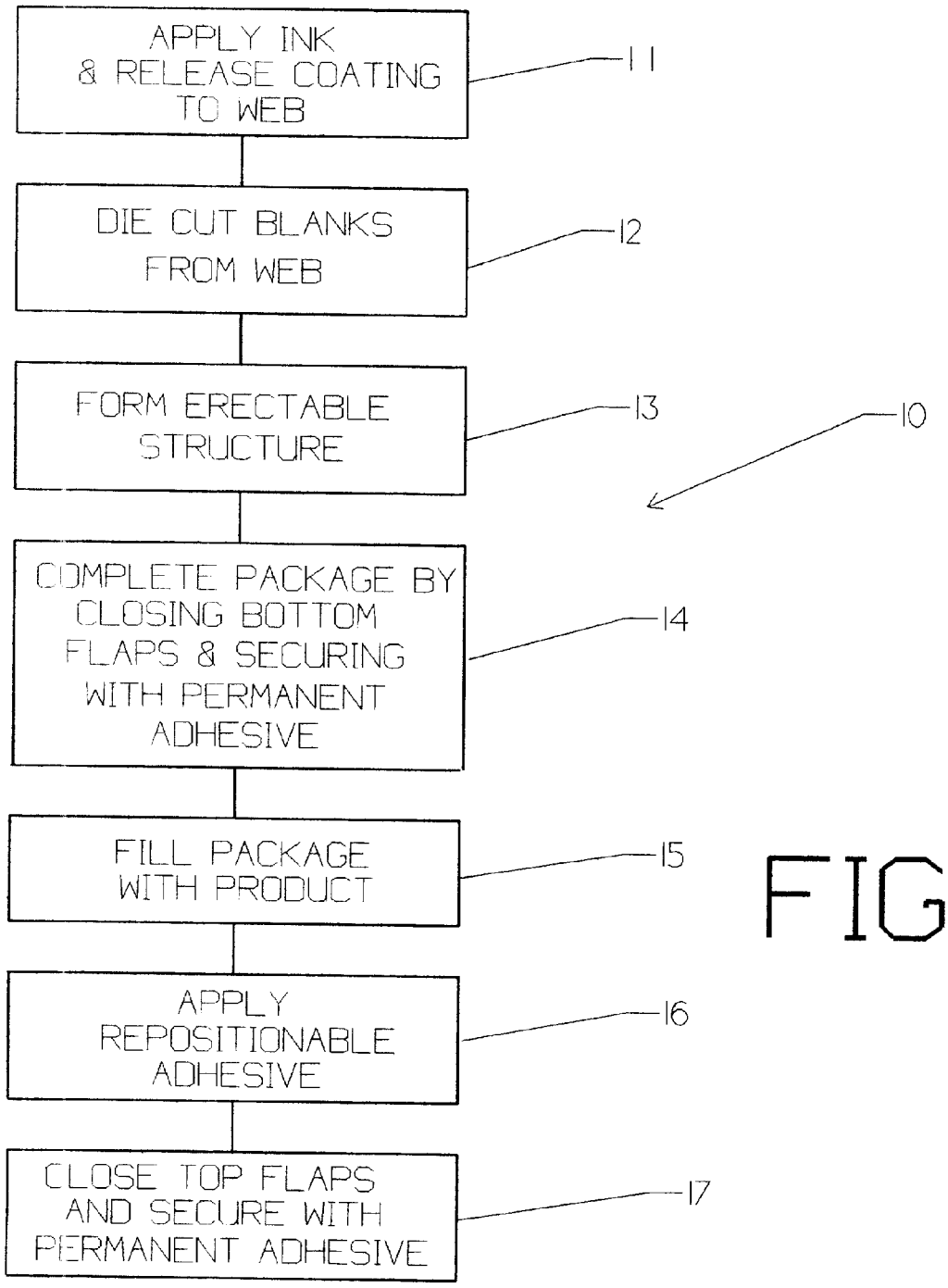
FIG. 1 is a flow chart of the method.

FIG. 1 shows the method 10 of creating a package, the method comprising steps 11–17. In the method, step 11 is performed first where ink and release coating are applied to respective first and second predetermined areas on one side of an extended web of material of cardboard, plastic, a sheet of cardboard or plastic, or any other suitable package material.

Figure 2:
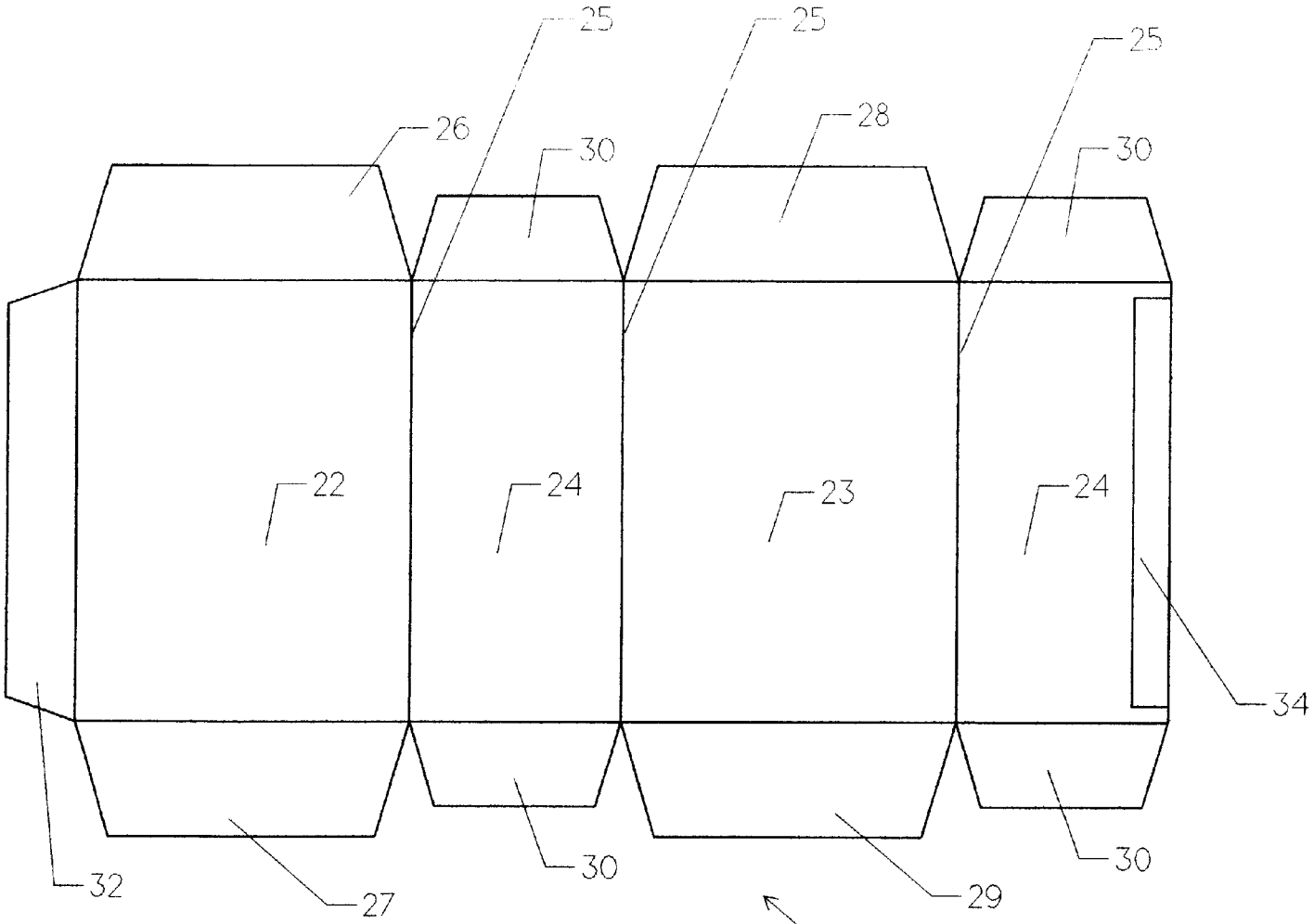
FIG. 2 is a top view of the blank.

Step 12 is then performed where blanks 20 are cut from the web or sheet using a die having the outline as shown in FIG. 2. Blank 20 has a generally rectangular center section made up of two major areas 22, 23 and two minor areas 24, the center section being generally rectangular in shape and having a width as the major dimension and a length as the minor dimension between generally parallel boundaries 25 which extend across the width of the center section perpendicular to its length. The center section length is designated along this dimension because the length of the completed package will also have a length along this same dimension. Major flaps 26, 27 and 28, 29 are shown as extending outwardly from opposite ends of respective major areas 22, 23 across the width of the center section. Major flaps 26, 28 and 27, 29 are dimensioned such that they will overlap on the completed package, as will be described later. Minor flaps 30 extend from opposite ends of the minor areas 24 across the width of the center section. As depicted here major flaps 26, 27 are wider than minor flaps 30; however, they can be of equal width since the only requirement is that major flaps 26, 27, 28, 29 have generally equal widths and minor flaps 30 be of equal width in forming a package.

An overlap extension 32 is shown as extending outwardly from the outermost edge along the width of major area 22. Overlap extension 32 could extend outwardly from end outermost minor area 24 with no essential change in the invention method. Overlap area 32 will be opposite and adjacent to overlap opposite area 34 when the blank is formed into a structure as described below. If desired, a cut out can be provided in the outermost flap 26 for finger access when opening the flaps.

Step 13 is then performed where blank 20 is formed into an erectable structure by bending all of the areas adjacent to boundaries 25 at right angles to one another and by bending overlap extension 32 at right angles to its adjacent area, in this example major area 22, to position it adjacent to and overlapping area 34. At the same time a permanent adhesive is applied on an area or areas 34 to attach area or areas 34 to overlap extension 32 and complete the structure.

Step 14 is then performed where minor flaps 30, shown at the bottom of FIG. 2, and major flaps 27, 29 are bent inward toward each other at right angles. Major flaps 27 and 29 are then attached to one another by permanent adhesive placed between their adjacent areas which completes the package.

Step 15 is then performed where the package 36 is filled with a product (not shown).

Figure 3:
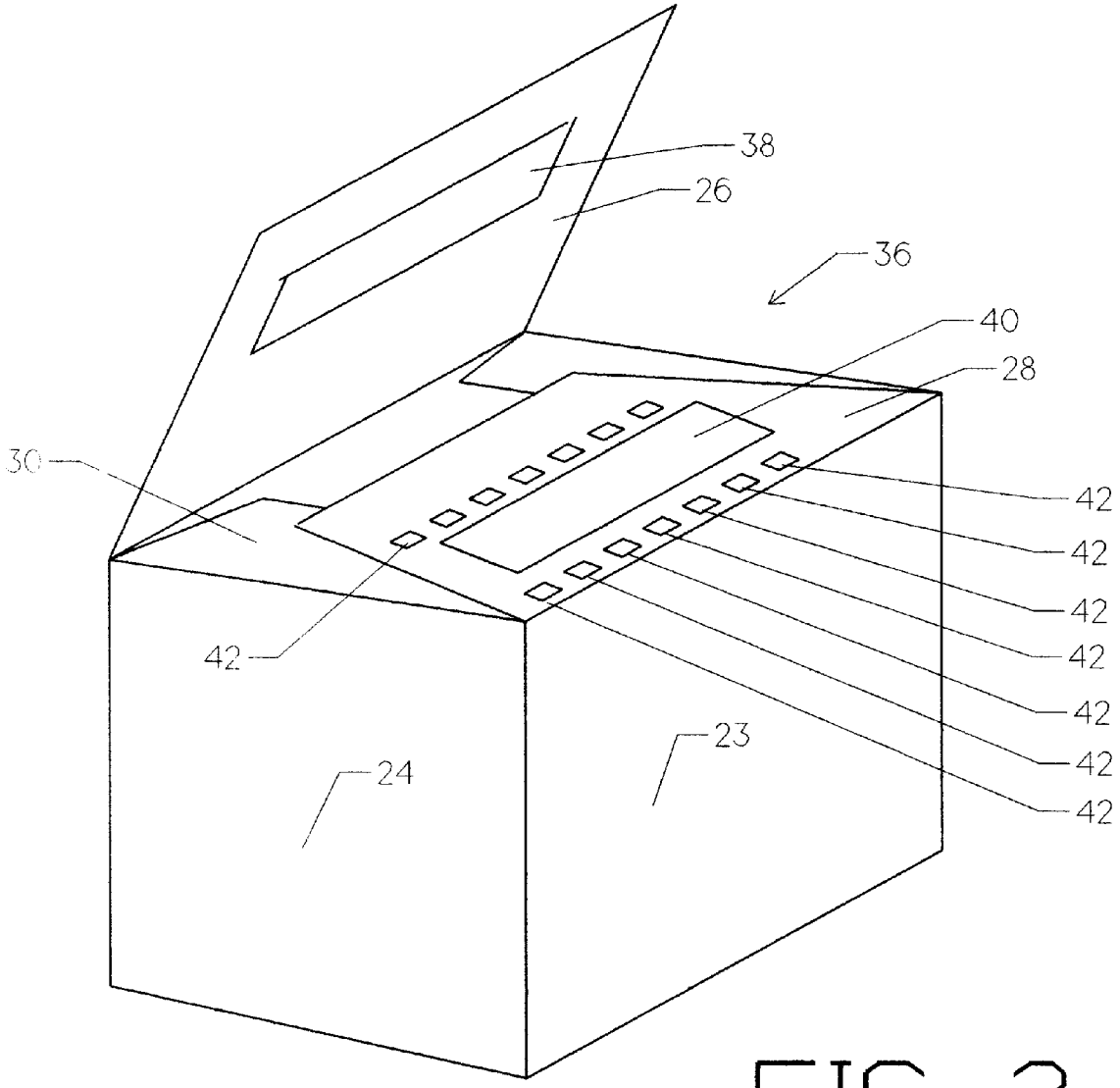
FIG. 3 shows the arrangement of the top flaps on the package before the flaps are closed.
Figure 4:
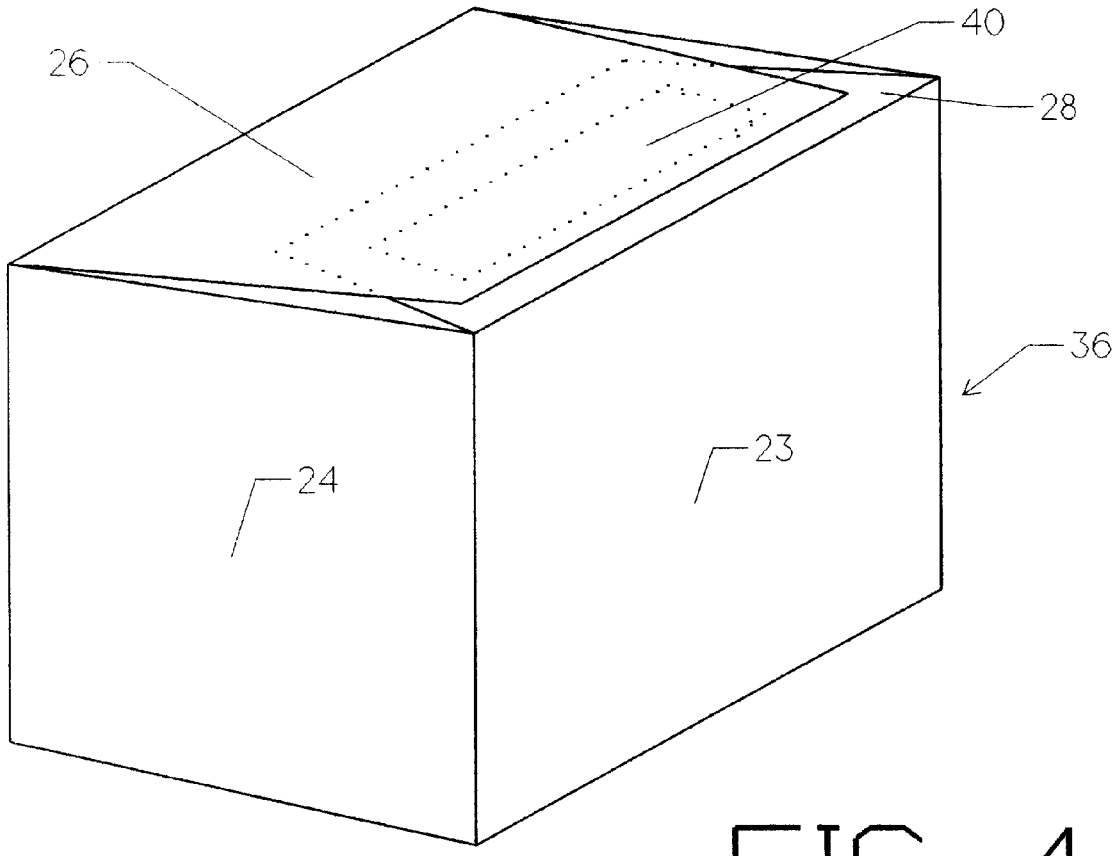
FIG. 4 shows the arrangement of the top flaps on the package after the flaps are closed.
Figure 5:
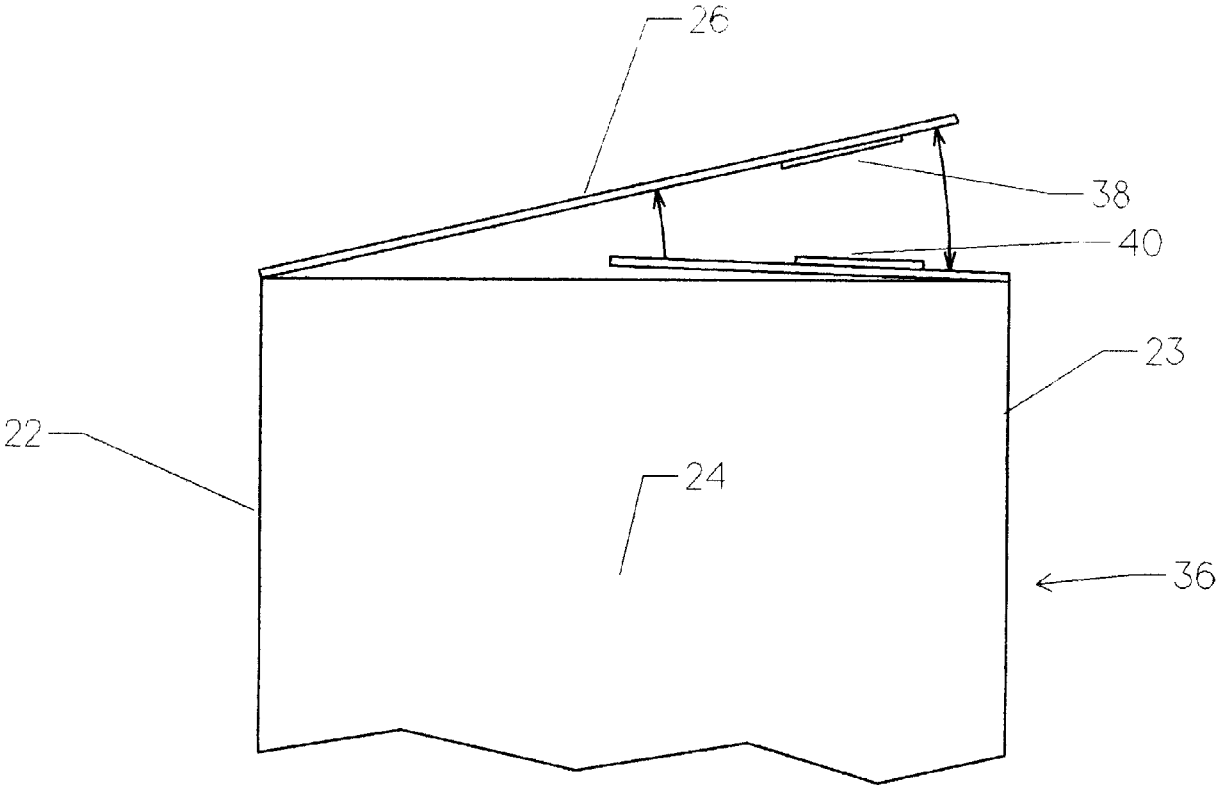
FIG. 5 shows the arrangement of the top flaps on the package when the top flaps are opened after initial closure.

Step 16 is then performed where, as shown in FIG. 3, package upper minor flaps 30, then major flap 28 and lastly major flap 26 are folded inward with respect to their adjacent sides. During this sequence release coating 38 can be carried on the inner surface of major flap 26. In a first method, repositionable adhesive 40 is then applied to the inner surface of opposing major flap 28 which is directly opposite and adjacent to release coating 38 when the major flaps are closed.

In a second method, the repositionable adhesive 40 is applied onto the release coating 38. When major flap 26 is closed over major flap 28, adhesive 40 will transfer to flap 28 because the adhesive adheres better to the flap material than the release coating.

In a third method, no release coating is utilized.

A plurality of small areas of permanent adhesive 42 are then applied to the inner surface of major flap 28 at locations not opposite release coating 38, or, if a release coating is applied, not on repositionable adhesive. If desired, permanent adhesive 42 can also or exclusively applied to the inner surface of major flap 26 not on release coating 38 or not opposite repositionable adhesive 40 with the same results.

The use of a plurality of small areas of permanent adhesive provides an initial positive closure which can readily be overcome by a reasonable amount of force when the package is first opened. The arrangement of the repositionable adhesive opposite the release coating also permits a ready opening of the major flaps when opening the top end of the package. Having the repositionable adhesive located at that position of the opposite flap directly opposite either the release coating or merely the opposite major flap will result in the major flaps being resealed whenever they are brought to a close disposition. The only difference, as previously noted, is that omitting the release coating will render the package less durable. This arrangement permits opening and later resealing the major flaps on the upper end of the package a number of times. A package in accordance with the invention provides an easy way of initially opening a package and an easy way of later closing and resealing the package multiple times. Since the outer flap needs only be pressed against the inner flap to provide a closure and seal, with no necessity of threading an extension within a slot, the closure and resealing is simple and quick. This arrangement also provides a significant percentage of the original closure strength and a similar amount of sealing effectiveness as the original closure.

While this invention has been described with respect to specific embodiments, these descriptions are not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A method of creating a package comprising the steps of:

a) applying ink and a release coating to one side of a material to respective first and second predetermined areas;

b) die stamping the material to provide a preformed cardboard blank with a center section erectable to form a generally rectangular shaped, three dimensional containing portion, the center section including a plurality of spaced apart parallel boundaries generally perpendicular to the length which divide the center section width into four areas, the areas consisting of two equal sized first and second major areas and two equal sized first and second minor areas, the major and minor areas being alternating with respect to one another, the blank further including an overlap extension extending from an outside edge of the center section across its width; the blank further including major and minor flaps extending outwardly from both opposite edges of each respective major and minor area along the center section length, the flaps extending from the first major area being designated as first major flaps and the flaps extending from the second major areas being designated as second major flaps, and with the first major flaps having a reach such that, when the major flaps are closed on a package, the first major flaps will overlap the second major flaps;

c) forming an erectable structure by flexing the center section along boundaries between the major and minor areas essentially to define right angles, and flexing the overlap extension essentially to a right angle relative to the adjacent side such as to form a flat sided column with the inked area on the outside and applying a permanent adhesive between the overlapped areas;

d) forming a package by closing a bottom end of the structure by first flexing the flaps from the minor areas and then flexing the flaps from the major areas inward at right angles along the boundaries between the flaps and their respective adjacent areas such that the minor flaps are innermost and the first major flap is outermost; and attaching overlapped adjacent areas of the first and second major flaps together using permanent adhesive;

e) filling the package with product through an open top end;

f) applying a repositionable adhesive to overlie the release coating on at least one of said major flaps; and g) closing the open top end of the package by first flexing the flaps from the minor areas and then flexing the flaps from the major areas inward at right angles along the boundaries between the flaps and their respective adjacent areas such that the minor flaps are innermost and the first major flap is outermost; and securing overlapped adjacent areas of the first and second major flaps together by a permanent adhesive applied to an area other than that occupied by the release coating and repositionable adhesive.

2. Apparatus formed in accordance with the method of claim 1.

3. A method of creating a package comprising the steps of:

a) applying ink and a release coating to one side of a web of material to respective first and second predetermined areas;

b) die stamping the web material to provide a preformed cardboard blank with a generally rectangular shaped center section across a length and a perpendicular width, the center section including a plurality of spaced apart parallel boundaries generally perpendicular to the length which divides the center section width into four areas, the areas consisting of two equal sized first and second major areas and two equal sized first and second minor areas, the major and minor areas being interspersed with one another and the distances between boundaries for the major and the minor areas can be unequal, the blank further includes an overlap extension extending outward from one of the outside edges of the center section across its width; the blank further provided with major and minor flaps which extend outwardly from both edges of each respective major and minor area along the center section length, with the flaps extending from the first major areas being designated as first major flaps and the flaps extending from the second major areas being designated as second major flaps, and with the first major flaps having a reach such that, when the major flaps are closed on the resulting package, the first major flaps will overlap the second major flaps;

c) forming an erectable structure by bending the sides adjacent to the boundaries between the major and minor areas to essentially right angles, and bending the overlap extension essentially to a right angle with the adjacent side such as to form a flat sided column with the inked area on the outside and the non-inked side of the overlap extension overlapping the inked side of the opposite area; then applying a permanent adhesive between the overlapped areas;

d) forming a package by closing one end of the structure to form a bottom end of the structure by first bending the flaps from the minor areas and then bending the flaps from the major areas inward at right angles along the boundaries between the flaps and their respective adjacent areas such that the minor flaps are innermost and the first major flap is outermost; then attaching overlapped adjacent areas of the first and second major flaps together using permanent adhesive;

e) filling the package with product through the open end;

f) applying a repositionable adhesive over that area of the first major flap on the side which will be adjacent to and overlap the release coating on the second major flap, when the flaps are closed adjacent to each other with the second major flap outermost on the resulting package; and g) closing the open end of the package by bending the flaps from the minor areas and the flaps from the major areas inward at right angles along the boundaries between their respective areas with the minor flaps innermost and the second major flap with the greatest reach outermost; and attaching overlapped adjacent areas of the first and second major flaps together by a plurality of small areas of permanent adhesive applied to areas other than those covered by the release coating and the repositionable adhesive.

4. Apparatus formed in accordance with the method of claim 3.

5. A method of creating a package comprising the steps of:

a) applying ink to one side of a web of material to respective first and second predetermined areas;

b) die stamping the web material to provide a preformed cardboard blank with a generally rectangular shaped center section across a length and a perpendicular width, the center section including a plurality of spaced apart parallel boundaries generally perpendicular to the length which divides the center section width into four areas, the areas consisting of two equal sized first and second major areas and two equal sized first and second minor areas, the major and minor areas being interspersed with one another and the distances between boundaries for the major and the minor areas can be unequal, the blank further includes an overlap extension extending outward from one of the outside edges of the center section across its width; the blank further provided with major and minor flaps which extend outwardly from both edges of each respective major and minor area along the center section length, with the flaps extending from the first major areas being designated as first major flaps and the flaps extending from the second major areas being designated as second major flaps, and with the first major flaps having a reach such that, when the major flaps are closed on the resulting package, the first major flaps will overlap the second major flaps;

c) forming an erectable structure by bending the sides adjacent to the boundaries between the major and minor areas to essentially right angles, and bending the overlap extension essentially to a right angle with the adjacent side such as to form a flat sided column with the inked area on the outside and the non-inked side of the overlap extension overlapping the inked side of the opposite area; then applying a permanent adhesive between the overlapped areas;

d) forming a package by closing one end of the structure to form a bottom end of the structure by first bending the flaps from the minor areas and then bending the flaps from the major areas inward at right angles along the boundaries between the flaps and their respective adjacent areas such that the minor flaps are innermost and the first major flap is outermost; then attaching overlapped adjacent areas of the first and second major flaps together using permanent adhesive;

e) filling the package with product through the open end;

f) applying a repositionable adhesive over that area of the first major flap on the side which will be adjacent to and overlap the second major flap, when the flaps are closed adjacent to each other with the second major flap outermost on the resulting package;

g) closing the open end of the package by first bending the flaps from the minor areas and then bending the flaps from the major areas inward at right angles along the boundaries between the flaps and their respective adjacent areas such that the minor flaps are innermost and the first major flap is outermost; then attaching overlapped adjacent areas of the first and second major flaps together by a plurality of small areas of permanent adhesive applied between areas other than those covered by the repositionable adhesive.

6. Apparatus formed in accordance with the method of claim 5.

* * * * *